US006923100B2

(12) United States Patent
Birch et al.

(10) Patent No.: US 6,923,100 B2
(45) Date of Patent: Aug. 2, 2005

(54) METHOD AND APPARATUS FOR PUNCHING PARTICLE BOARD

(75) Inventors: James R. Birch, Muscatine, IA (US); Ralph Hohneke, Muscatine, IA (US); Steven J. Kleis, Allentown, PA (US); Leonard C. Sloat, Pella, IA (US); Melissa Perez, Muscatine, IA (US); Brad R. Hansen, Muscatine, IA (US)

(73) Assignee: HNI Technologies Inc., Muscatine, IA (US)

( * ) Notice: Subject to any disclaimer, the term of this patent is extended or adjusted under 35 U.S.C. 154(b) by 0 days.

(21) Appl. No.: 10/114,965

(22) Filed: Apr. 1, 2002

(65) Prior Publication Data

US 2003/0183057 A1 Oct. 2, 2003

(Under 37 CFR 1.47)

(51) Int. Cl.[7] ..... B26F 1/14
(52) U.S. Cl. ..... 83/55; 83/686; 83/690
(58) Field of Search ..... 83/686, 98, 684, 83/689, 694, 690, 55

(56) References Cited

U.S. PATENT DOCUMENTS 2,182,744 A * 12/1939 Ehrsam ..... 83/98
2,369,896 A * 2/1945 Harris ..... 83/685
3,670,610 A * 6/1972 Cady, Jr. ..... 83/55
4,587,737 A * 5/1986 Wilson ..... 30/358
4,628,780 A * 12/1986 Hicks ..... 83/99
4,989,482 A * 2/1991 Mason ..... 83/22
5,052,097 A * 10/1991 Becker ..... 29/563
5,189,779 A 3/1993 Fishel et al.
6,067,830 A * 5/2000 Klages et al. ..... 72/55
2001/0020409 A1 * 9/2001 Hashimoto et al. ..... 83/146

* cited by examiner

*Primary Examiner*—Kenneth E. Peterson
(74) *Attorney, Agent, or Firm*—Ronald A. Sandler; Jones Day

(57) ABSTRACT

A punch and backer plate combination is disclosed as an example of the present invention. The punch has a concave recess in its extended end. The punch may be round or have a rectangular shape in plan view and includes a backer plate having an aligned opening with a similar shape to the punch plus a clearance dimension. The aligned opening of the backer plate includes an upper portion and a lower portion, where the lower portion is enlarged in comparison to the upper portion to allow relief for a slug of material from the workpiece.

9 Claims, 2 Drawing Sheets

METHOD AND APPARATUS FOR PUNCHING PARTICLE BOARD

BACKGROUND OF THE INVENTION

1. Field of the Invention

The present invention relates to a method and apparatus for punching particle board and more particularly to a method and apparatus for forming openings in particle board using a superior stress relief mechanism.

2. Description of the Related Art

Laminated and veneered particle board is often used to form furniture as well as other products. Typically there is a need to form openings in the particle board to allow the passage of wires and cables. These openings generally receive grommets. For example, U.S. Pat. No. 5,189,779 illustrates the formation of an opening in a wall panel using a drilling operation. Forming furniture pieces or wall panels using a punching operation is often desirable because it is a relatively inexpensive manufacturing technique; however, punching operations are very stressful to the material being punched. Too much side stress causes cracks and breaks in the material and is, of course, undesirable should the cracks or breaks appear in the surface of a desk, for example.

BRIEF SUMMARY OF THE INVENTION

The difficulties encountered previously have been overcome by the present invention. What is described here is a method for punching particle board comprising the steps of placing a punch having an extended end with a concave recess in a press, placing a backer plate under the punch on the press, the backer plate include an opening aligned with the punch, placing a particle board between the punch and the backer plate and forcing the punch into the particle board to cause an opening to be formed in the particle board. The invention also includes a punch and backer plate combination for a punch press comprising a punch having a generally cylindrical shape for attachment to a press, the punch having an extended end portion including a concave recess, and the backer plate having an opening with a shape generally identical to the shape of the punch in plan view.

There are a number of advantages, features and objects achieved with the present invention which are believed not to be available in earlier related devices and methods. For example, one advantage is that the present invention provides a method which is simple, relatively inexpensive and effective. Another object of the present invention is to provide a method for punching particle board which does not unduly stress the particle board. A further advantage of the present invention is to provide a method for punching particle board which relieves stress upwardly instead of sideways. A further feature of the present invention is to provide a punching apparatus which is inexpensive yet effective for forming openings in particle board. Another advantage is that the present invention provides for an apparatus which reduces stress in a particle board workpiece during a punching operation. Still another feature of the present invention is to provide an apparatus which is simply constructed and easy to use.

A more complete understanding of the present invention and other objects, advantages and features thereof will be gained from a consideration of the following description of preferred embodiments read in conjunction with the accompanying drawing provided herein. The preferred embodiments represent examples of the invention which are described here in compliance with Title 35 U.S.C. section 112 (first paragraph), but the invention itself is defined by the attached claims.

DETAILED DESCRIPTION OF A PREFERRED EMBODIMENT OF THE INVENTION

Figure 1:
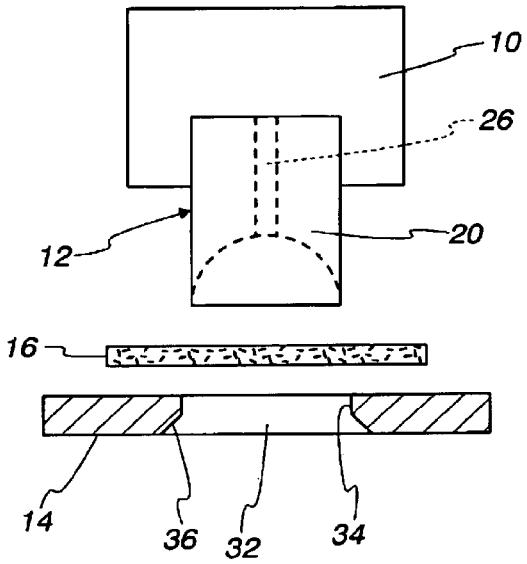
FIG. 1 is a schematic view of a press partially in cross section, with a punch, a backer plate and a workpiece.

While the present invention is open to various modifications and alternative constructions, the preferred embodiments shown in the drawing will be described herein in detail. It is understood, however, that there is no intention to limit the invention to the particular embodiments, forms or examples disclosed. On the contrary, the intention is to cover all modifications, equivalent structures and methods, and alternative constructions falling within the spirit and scope of the invention as expressed in the appended claims, pursuant to Title 35 U.S.C. section 112 (second paragraph).

Figure 2:
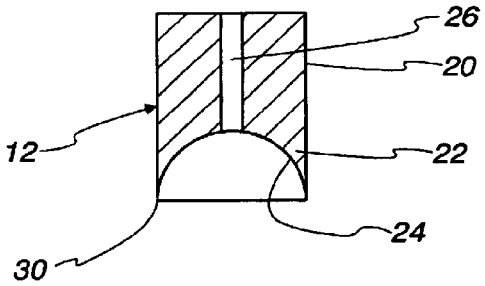
FIG. 2 is a schematic sectional elevation view of a punch.
Figure 3:
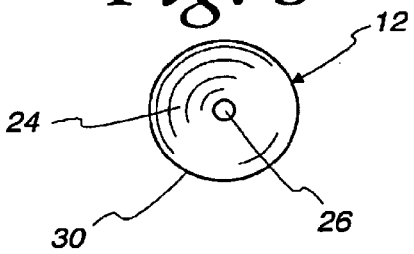
FIG. 3 is a schematic bottom plan view of the punch of FIG. 2.

Referring now to FIGS. 1–3, there is illustrated a hydraulic press 10 to which is mounted a punch 12. Mounted opposite the punch is a backer plate 14 and positioned between the punch and the backer plate is a workpiece 16. The workpiece is laminated or veneered particle board to be used for furniture or the like where at least one surface is exposed and thus ought to be aesthetically attractive.

The punch has a generally cylindrical shape and is round in plan view with an upper portion 20 and a lower portion 22. Formed in the lower portion is a concave recess 24 being generally hemispherical in shape and a central opening 26. By having the concave recess, a cutting edge 30 is formed at the lower end of the punch.

It is contemplated that the diameter of the punch is about 2.5 inches, that the radius of the hemispherical concave opening is about 1.375 inches and that the depth of the recess is about 0.813 inches from the edge 30.

The backer plate 14 includes an opening 32 which has an upper portion 34 having a diameter of about 2.53 inches so as to provide a clearance around the punch of about 0.015 inches. A lower portion 36 of the backer plate is beveled to a larger opening to allow relief for a punched slug of material from the workpiece 16.

The press may be an "H" frame hydraulic press which develops a pressure of 3000 psig to operate the punch through a 2.5 inch stroke in a time frame of six to seven seconds.

It has been found that a punch of the above dimensions operating with the above mentioned pressure, stroke and time frame performs very well in forming an opening without unacceptable damage to the aesthetically attractive exposed surface.

Figure 4:
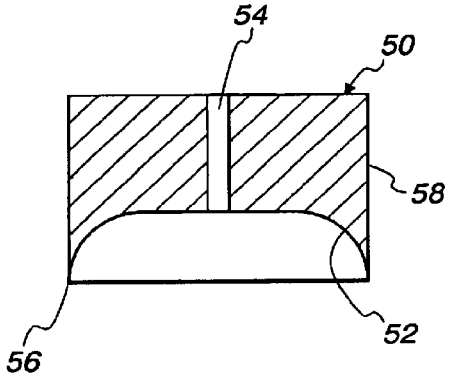
FIG. 4 is a schematic sectional elevation view of another embodiment of a punch.
Figure 5:
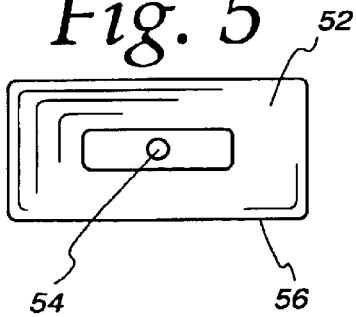
FIG. 5 is a schematic bottom plan view of the punch of FIG. 4.

Referring now to FIGS. 4 and 5, another embodiment of a punch is illustrated. The punch 50 instead of having a round shape in plan view has a generally rectangular shape. As with the FIGS. 2 and 3 embodiment, the punch 50 has a concave recess 52 and a central opening 54. Also as with the punch 12, the punch 50 has a generally sharp bottom edge 56 formed by the recess and an outer surface 58 of the punch. The central opening 26, FIGS. 1–3, and the central opening 54, FIGS. 4–5, are provided for the transmission of compressed air as is known by those skilled in the art.

Further, as with the punch 12, the punch 50 allows stress relief upwardly instead of causing side stresses.

Figure 6:
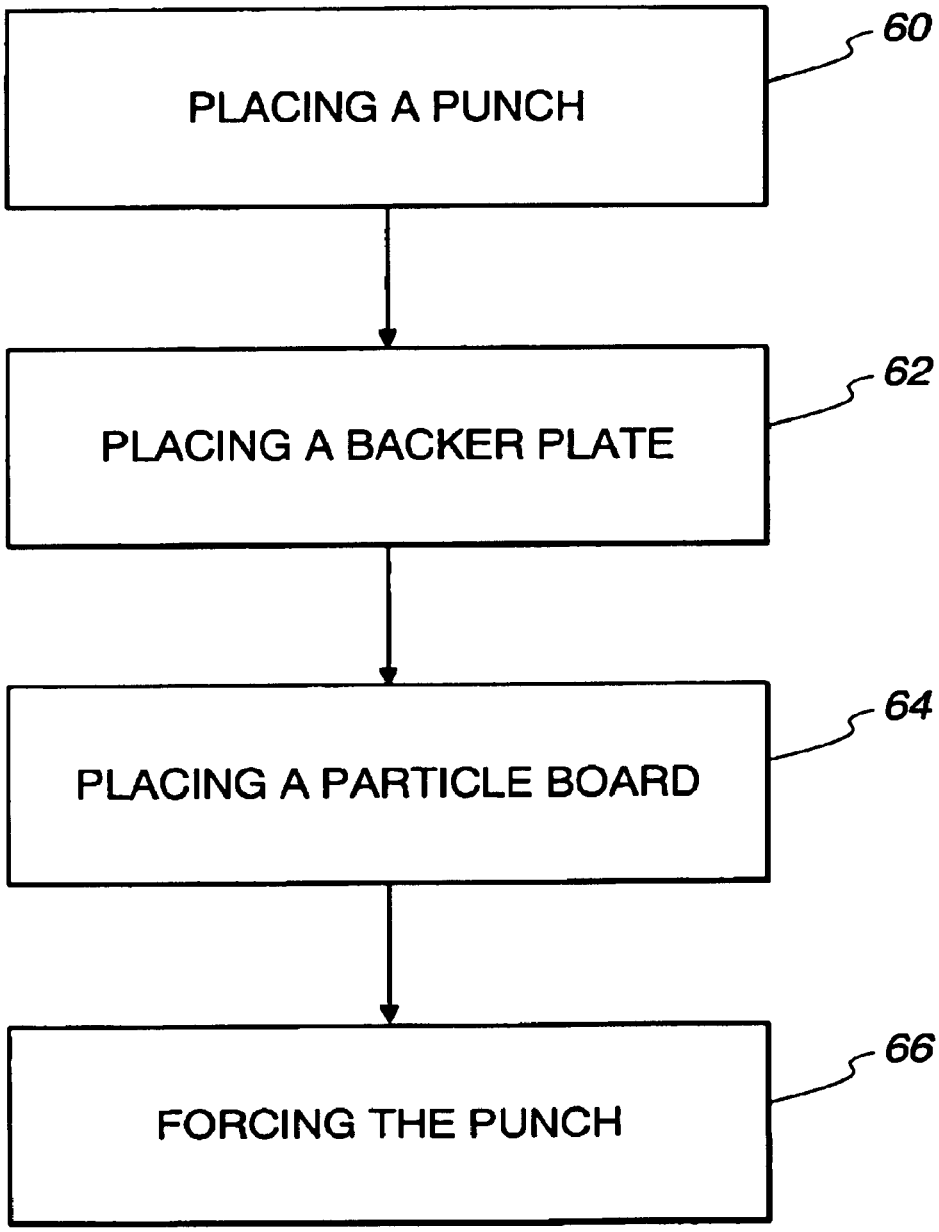
FIG. 6 is a flow diagram of a method for punching particle board.

A method for punching particle board is shown in FIG. 6 in a flow diagram. The first box 60 represents placing the punch 12 or the punch 50 in a press. The second box 62 represents placing the backer plate 14 on the press such that the opening 32 of the backer plate is aligned with the punch. The next box 64 represents the placement of the laminated or veneered particle board on the press between the punch and the backer plate. The fourth box 66 represents forcing the punch into the particle board to cause a slug of material to be removed and an opening to be formed in the particle board.

It can now be appreciated that the method described is simple, relatively inexpensive and effective. This is because the punch and backer plate combination is relatively inexpensive and yet is a effective tool for inexpensively forming openings in sensitive laminated or veneer covered particle board.

The above specification describes in detail two preferred embodiments of the present invention. Other examples, embodiments, modifications and variations will, under both the literal claim language and the doctrine of equivalents, come within the scope of the invention defined by the appended claims. For example, changing the shape of the punch in plan view or the shape of the opening in the backer plate or the dimensions are considered equivalent and will also come within the literal language of the claims. Still other alternatives will also be equivalent as will many new technologies. There is no desire or intention here to limit in any way the application of the doctrine of equivalents nor to limit or restrict the scope of the claims.

What is claimed is:

1. A method for forming an opening in particle board having a surface that is aesthetically attractive, said method comprising the steps of:

placing a punch in a press, said punch having a radius, a central opening and an extended end with an edge formed by a generally hemispherical recess in said extended end, said generally hemispherical recess having a radius larger than the radius of said punch;

placing a backer plate under said punch on said press, said backer plate having an opening larger than twice the radius of said punch to provide clearance, said backer plate opening being aligned with said punch, and said backer plate opening including a lower portion having a beveled periphery;

placing a particle board on said press between said punch and said backer plate; and pushing said punch by said press into said particle board over a time period of six to seven seconds, said particle board being cut, compressed and sheared during the pushing step.

2. The method of claim 1 wherein:

said particle board is laminated.

3. The method of claim 2 wherein:

said press develops a pressure of about 3000 psig; and said punch has a stroke of about 2.5 inches.

4. The method of claim 1 wherein:

said particle board has a veneered surface.

5. The method of claim 1 wherein:

said press develops a pressure of about 3000 psig.

6. The method of claim 1 wherein:

said punch has a stroke of about 2.5 inches.

7. The method of claim 1 wherein:

said particle board is laminated; and said particle board has a veneered surface.

8. The method of claim 1 wherein:

said press develops a pressure of about 3000 psig; and said punch has a stroke of about 2.5 inches.

9. The method of claim 8 wherein:

said particle board is laminated; and said particle board has a veneered surface.

* * * * *